United States Patent [19]

Robson

[11] 4,314,317

[45] Feb. 2, 1982

[54] FLASHLIGHT

[76] Inventor: Jerry A. Robson, 76 Sherman Ave., Mansfield, Ohio 44906

[21] Appl. No.: 114,678

[22] Filed: Jan. 23, 1980

[51] Int. Cl.[3] ..... F21L 21/00

[52] U.S. Cl. ..... 362/189; 362/201

[58] Field of Search ..... 362/189, 201

[56] References Cited

U.S. PATENT DOCUMENTS

| | | | |
|---|---|---|---|
| 1,866,600 | 7/1932 | Rauch | 362/201 |
| 2,041,843 | 5/1936 | Lifschitz | 362/201 |
| 2,618,737 | 11/1952 | Beavis | 362/201 |
| 2,762,907 | 9/1956 | Schwartz | 362/201 |
| 3,226,880 | 1/1966 | Novello | 362/201 |
| 4,122,510 | 10/1978 | Halliday | 362/201 |

*Primary Examiner*—Benjamin R. Padgett
*Assistant Examiner*—Irwin Gluck
*Attorney, Agent, or Firm*—William Preston Hickey

[57] ABSTRACT

A flashlight having side by side compartments for storage and a battery respectively. The battery compartment has partial dividers for confining the battery and leaving a space for a contact strip having a leg portion on which the battery sits. A snap in divider fits above the battery to hold a lamp, and the top of the contact strip is bent inwardly to make contact with the base of the lamp. Different color light transmitting caps can be put over the lamp so that the flashlight can be used for spectator voting or approval. Preferably different color caps can be kept in the storage compartment.

4 Claims, 4 Drawing Figures

FLASHLIGHT

TECHNICAL FIELD

The present invention relates to flashlights; and more particularly to a throw away construction of flashlights.

BACKGROUND OF THE INVENTION

A number of potential uses occur for portable special purposes lights, provided that they can be manufactured cheaply enough. For example, a more orderly assemblage of spectators occurs if light codes are used by the spectators to large gatherings if they register their approval by lights rather than applause. Such a special purposes light only becomes practical when the cost of the light does not greatly exceed the cost of an energy source having a service life not greatly in excess of that required for the specific intended use. Another use of such a device could be for voting on issues, by having the voters register their vote by turning on a particular colored light. A colored photograph could be used to record the lights, and other votes could be taken while the lights in the photographs are being counted. For such uses, however, the lights must be inexpensive, reliable, and preferably contain a compartment for accessories, instructions, and/or color coded caps.

An object of the present invention is the provision of a new and improved inexpensive light uniquely suited for the above mentioned purposes.

A further object of the invention is the provision of a light of the above described type containing a single metal part with the exception of the bulb and dry cell, and a few plastic parts all of which can be made in a single multiple cavity mold fed with two types of plastic.

Further objects and advantages of the invention will become apparent to those skilled in the art to which the invention relates from the following description of applicant's preferred embodiments described with reference to the accompanying drawings.

DESCRIPTION OF THE PREFERRED EMBODIMENT

Figure 2:
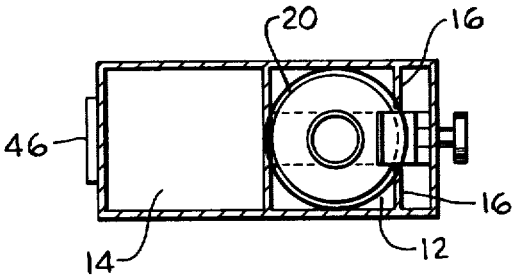
FIG. 2 is a cross sectional view taken approximately on the line 2—2 of FIG. 1.
Figure 4:
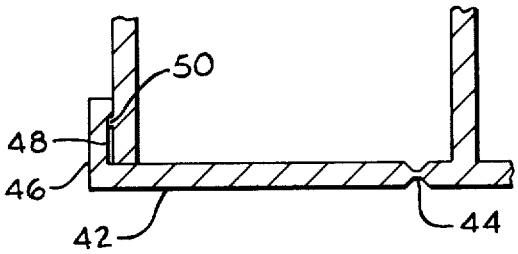
FIG. 4 is a fragmentary enlarged sectional view through the hinged bottom of the storage compartment.
Figure 1:
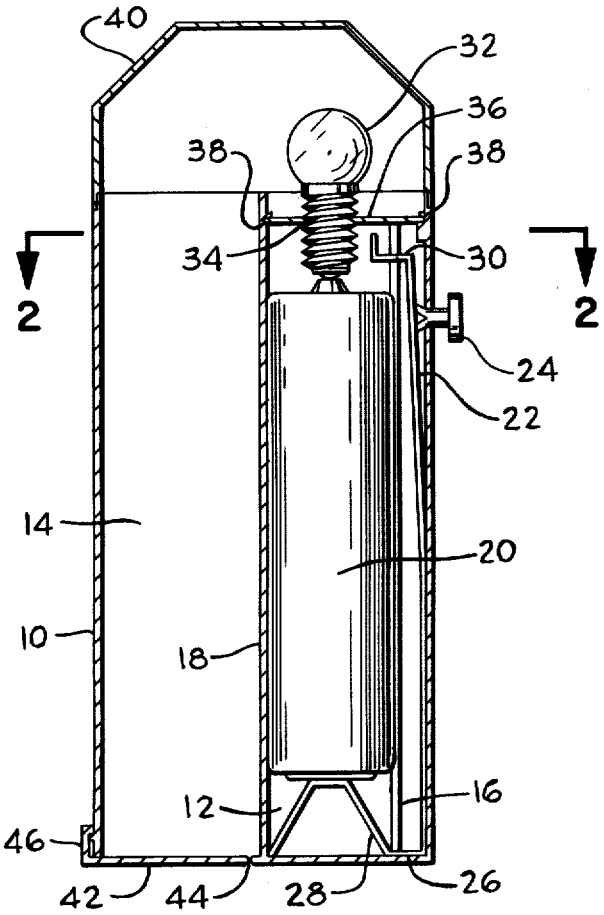
FIG. 1 is a vertical sectional view through a flashlight embodying principles of the present invention.
Figure 3:
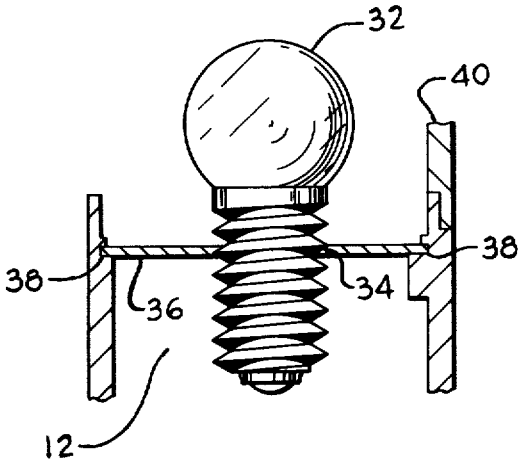
FIG. 3 is a fragmentary enlarged sectional view through the support plate for the lamp.

The embodiment shown in the drawings generally comprises a rectangular case 10 having two parallel rectangular chambers 12 and 14 therein both of which are open at the top end. Chamber 12 is a battery and contact containing chamber, and chamber 14 is a storage chamber. The sidewalls of the chamber 12 have a pair of fins 16, the respective members of which project from respective major sidewalls of the chamber 12 toward each other. The fins 16 are spaced from the partition 18 which separates the chambers 12 and 14 by an appropriate distance to confine a dry cell 20 between the fins and the partition 18. The ends of the fins 16 are spaced apart by a distance corresponding to the width of a brass electrical contact strip 22. The bottom half of the contact strip lays against the outer wall of chamber 12, and the top half is bent away from the wall at a slight angle to clear the inner end of a push button 24.

The contact strip 22 has a bottom leg 26 which passes between the fins 16 and is domed upwardly, as at 28, to support the bottom of the dry cell 20. The top end of the strip 22 is bent inwardly between the fins 16, as at 30, to a position just short of the metal base of a lamp 32. The lamp 32 is threaded into an opening 34 in a horizontal partition plate 36 that extends across the top of the chamber 12. The edges of the partition 36 snap into recesses 38 in the walls of the chamber 12 to hold it in position; and the opening 34 is located so as to position the bottom center contact of the lamp in line with the top center terminal of the dry cell. The domed portion 28 of the contact strip is sufficiently resilient to keep the dry cell in contact with the terminal of the lamp. The push button 24 has an enlarged split inner end that retains it loosely in position once it is inserted through its receiving opening. The top end of the case is closed by a light transmitting cover 40 that can be either clear or colored. The cover can be constructed to snap onto the case 10, but is shown as being notched to receive a lip on the top of the case. The lip and notch locate the cover, and a small amount of plastic solvent or cement adheres the cover to the case.

The bottom of compartment 14 is closed off by a hinged bottom 42 that is flexibly connected to the bottom of compartment 12 by a thinned section 44 (living hinge) of the plastic from which the case is molded. The hinged bottom is held closed by an upwardly extending lip 46 having a groove 48 therein which snaps over a projection 50 on the outside surface of the case.

Because of the few number and design of the parts, all of the parts can be made from cavities in a single set of mold plates. The case 10 including hinged bottom 42, the push button 24, and the horizontal partition plate 36 can be made from an opaque plastic, as for example, polystyrene; and the cover 40 can be made from a clear plastic. The construction of the parts is such that the cavities for all of the plastic parts can be located in a single split injection mold having one set of draw pins—all operated by a single press. The press can also be provided with two separate plastic melting and pressurizing chambers, so that all plastic parts for one light are made in a single injection molding operation.

It will be seen that the cover 40 is so shaped that a thin colored light transmitting cap, not shown, can be slid down over the cover and be restained by the parallel side edges of the cover. In a preferred embodiment, the height of the colored caps is made to be less than the minor dimension of the cross section of chamber 14, so that one or more colored caps can be stored in chambr 14. By this expediency, the lights can be manufactured in large quantities as a standard base item. The organizers of the assemblage can sell the light with a preselected colored cap or caps in the storage chamber 14. There are such a large number of colors which will register differently on colored film that it is highly unlikely that the voters would bring the proper shade of cap. By taking a yes vote with one color, and a no vote with another color, the total count of the lights in the two photographs should correspond to the total number of voters. Any discrepancy of color in the colored photographs from that of the color of the caps would indicate a spurious vote. The location of such a spurious vote would be identified on the photograph and could quickly be investigated. Since the vote would be taken in the dark, the identity of the voter could be kept secret since his face would not appear in the photograph.

One of the problems with flashlights of the above described type is that movement of the battery laterally with respect to the bulb can cause intermittent contact therebetween. In the construction described above, the fins 16 are deformed slightly when the battery is slid down into position between the fins 16 and partition 18; so that the battery is resiliently, laterally restrained and positioned relative to the base of the lamp 32. The domed portion 28 of the contact strip 22 bears against portions of the bottom that are located sufficiently close to the partition 18 and fins 16 that the resilient nature of the thermoplastic case yieldable biases the battery into contact with the bulb 32. The resilient nature of the plastic case is therefore utilized to maintain contact between the battery and bulb during shaking movement of the flashlight in any direction.

While the invention has been described in considerable detail, I do not wish to be limited to the particular embodiments shown and described, and it is may intention to cover hereby all novel adaptations, modifications, and arrangements thereof which come within the practice of those skilled in the art to which the invention relates, and which fall within the purview of the following claims.

I claim:

1. A flashlight comprising: a case having a first section with opposing narrow sides and opposing wide sides and having a bottom and a top; a pair of fins respective members of which project into said chamber towards each other from opposite wide sides of said case, said fins being spaced from one narrow side of said case to retain a battery between said one narrow side and said fins; a lamp supported adjacent the upper end of said internal chamber in position for its terminal to contact the upper terminal of the battery retained in said internal chamber; and a strip of conductive, flexible metal extending lengthwise of said internal chamber between said fins and the other one of said narrow sides, said strip having a first leg passing between said fins with an upwardly bent portion supported adjacent said bottom of said chamber to support the battery, and having a second leg adjacent the top of the battery and extending laterally inwardly between said fins for contact with a side portion of said lamp; and means for bending said flexible metal strip inwardly to bring said second leg of said strip against the base of the lamp to turn the lamp on.

2. The flashlight of claim 1 wherein said sides of said internal chamber have indentations therein adjacent the top thereof, a removable partition adapted to be snapped into said indentations for supporting said lamp; and an opening through said partition for receiving said lamp.

3. The flashlight of claim 1 wherein said case includes a second internal chamber parallel to said first internal chamber with a common sidewall therebetween, said case having a bottom which is intergral with the side walls of said first internal chamber and has a hinged portion beneath said second internal chamber, said hinged portion having a thinned section adjacent said common sidewall to form its hinge, and an upstanding leg which overlaps and engages a portion of the sidewall of said second internal chamber which is opposite from said common sidewall to retain said hinged portion in position closing off said second internal chamber.

4. The flashlight of claim 3 including a single molded light transmitting cap fitted to the outer walls of said case to both protect the lamp and enclose said second chamber.

* * * * *